US009781803B2

(12) United States Patent
Brandes

(10) Patent No.: US 9,781,803 B2
(45) Date of Patent: Oct. 3, 2017

(54) LED THERMAL MANAGEMENT SYSTEM AND METHOD

(75) Inventor: George R. Brandes, Raleigh, NC (US)

(73) Assignee: CREE, INC., Durham, NC (US)

( * ) Notice: Subject to any disclaimer, the term of this patent is extended or adjusted under 35 U.S.C. 154(b) by 1003 days.

(21) Appl. No.: 12/325,208

(22) Filed: Nov. 30, 2008

(65) Prior Publication Data

US 2010/0134024 A1 Jun. 3, 2010

(51) Int. Cl.
*H05B 37/02* (2006.01)
*H05B 33/08* (2006.01)

(52) U.S. Cl.
CPC ..... *H05B 33/0887* (2013.01); *H05B 33/089* (2013.01)

(58) Field of Classification Search
CPC .. H05B 33/0884; H05B 33/089; H05B 37/02; H02H 5/04; H02H 5/047; H02H 3/08
USPC ..... 315/185 R–185 S, 291–325, 112–118, 315/401, 91, 93, 119, 149, 279; 361/103, 361/93.8, 91.5, 274.3
See application file for complete search history.

(56) References Cited

U.S. PATENT DOCUMENTS 3,254,334 A 5/1966 Mitchell
4,132,925 A * 1/1979 Schmutzer et al. ..... 315/208
4,451,767 A * 5/1984 Goralnik ..... 315/309
4,666,252 A 5/1987 Yaniv et al.
5,329,153 A 7/1994 Dixit
5,661,374 A 8/1997 Cassidy et al.
5,726,484 A 3/1998 Hart et al.
5,914,501 A 6/1999 Antle et al.
5,939,839 A * 8/1999 Robel et al. ..... 315/289
6,153,980 A 11/2000 Marshall et al.
6,349,023 B1 * 2/2002 Greenberg ..... 361/103
(Continued)

FOREIGN PATENT DOCUMENTS

EP 1526759 A2 4/2005
JP 2000-208817 A 7/2000
(Continued)

OTHER PUBLICATIONS

Renesas Technology Corp., "Zener Diodes for LED Protection", "http://www.renesas.com/en/diode", Jun. 2006, p. 1.
(Continued)

*Primary Examiner* — Jimmy Vu
*Assistant Examiner* — Henry Luong
(74) *Attorney, Agent, or Firm* — Hultquist, PLLC; Steven J. Hultquist

(57) ABSTRACT

A thermal management system for reducing or eliminating heat-mediated degradation of LED performance and/or operating life. The system may include a thermal controller arranged to respond to an LED operating condition, and to responsively limit temperature in the LED. The thermal controller in one implementation includes a bypass circuit containing a bypass control element, such as a varistor, Zener diode, or antifuse device, and arranged to divert current from flowing to the LED so that the LED remains in a cool state, e.g., below 75° C. The system may be arranged to (I) at least partially attenuate the power supplied to an LED so as to reduce heat generation in such LED and maintain the LED below a threshold temperature and/or (II) remove heat from the LED to maintain temperature of the LED below a threshold temperature.

22 Claims, 3 Drawing Sheets

(56) References Cited

U.S. PATENT DOCUMENTS

| | | | | |
|---|---|---|---|---|
| 6,628,491 | B1 * | 9/2003 | Tihanyi et al. | 361/93.8 |
| 6,657,841 | B1 * | 12/2003 | Melchert et al. | 361/100 |
| 6,926,524 | B2 * | 8/2005 | Cao | 433/29 |
| 7,732,942 | B2 | 6/2010 | Janning | |
| 2002/0043943 | A1 | 4/2002 | Menzer et al. | |
| 2003/0122139 | A1 * | 7/2003 | Meng et al. | 257/81 |
| 2004/0012033 | A1 | 1/2004 | Yoo | |
| 2004/0021425 | A1 | 2/2004 | Foust et al. | |
| 2005/0167680 | A1 | 8/2005 | Shei et al. | |
| 2005/0174473 | A1 | 8/2005 | Morgan et al. | |
| 2005/0243539 | A1 * | 11/2005 | Evans et al. | 362/84 |
| 2006/0002187 | A1 | 1/2006 | Forbes | |
| 2006/0056123 | A1 | 3/2006 | Aoyagi et al. | |
| 2006/0220585 | A1 | 10/2006 | Negley et al. | |
| 2007/0030611 | A1 | 2/2007 | Cho et al. | |
| 2007/0108843 | A1 | 5/2007 | Preston et al. | |
| 2007/0131945 | A1 | 6/2007 | Lin et al. | |
| 2007/0188113 | A1 * | 8/2007 | Okamoto | 315/291 |
| 2007/0221943 | A1 | 9/2007 | Moriya et al. | |
| 2007/0279812 | A1 | 12/2007 | Sasaki | |
| 2008/0007885 | A1 | 1/2008 | Mehrl et al. | |
| 2008/0019124 | A1 | 1/2008 | Smith et al. | |
| 2008/0173935 | A1 | 7/2008 | Miyajima | |
| 2008/0231198 | A1 | 9/2008 | Zarr | |
| 2008/0278954 | A1 * | 11/2008 | Speier | 362/373 |
| 2009/0021185 | A1 * | 1/2009 | Ng | 315/294 |
| 2009/0115703 | A1 * | 5/2009 | Cok | 345/76 |
| 2009/0189549 | A1 * | 7/2009 | Crawford et al. | 315/309 |
| 2009/0219460 | A1 | 9/2009 | Takeda et al. | |
| 2010/0027276 | A1 * | 2/2010 | Kornitz et al. | 362/373 |
| 2010/0066271 | A1 | 3/2010 | Ito et al. | |
| 2010/0084979 | A1 * | 4/2010 | Burton et al. | 315/82 |
| 2011/0012514 | A1 * | 1/2011 | Olson et al. | 315/152 |

FOREIGN PATENT DOCUMENTS

| | | | | |
|---|---|---|---|---|
| JP | 2000-231363 | A | | 8/2000 |
| JP | 2002009343 | A | * | 1/2002 |
| JP | 2005-301103 | A | | 10/2005 |
| JP | 2006-86300 | A | | 3/2006 |
| JP | 2007-165161 | A | | 6/2007 |
| JP | 2007-200577 | A | | 8/2007 |
| JP | 2007-305512 | A | | 11/2007 |
| JP | 2008-177328 | A | | 7/2008 |
| JP | 2008204866 | A | | 9/2008 |
| JP | 2011-507258 | A | | 3/2011 |
| KR | 20-0306797 | Y1 | | 3/2003 |
| KR | 20030068524 | A | | 8/2003 |
| KR | 1020060108757 | A | | 10/2006 |
| KR | 200070006073 | A | | 1/2007 |
| KR | 10-0863294 | B1 | | 10/2008 |
| WO | 2005055379 | A1 | | 6/2005 |
| WO | 2005060309 | A2 | | 6/2005 |
| WO | 2008146811 | A1 | | 12/2008 |
| WO | 2009077932 | A1 | | 6/2009 |

OTHER PUBLICATIONS

Wikipedia , "Antifuse", "http://en.wikipedia.org/wiki/Antifuse", Jun. 28, 2008, Publisher: Wikipedia Foundation Inc.; pp. 2.

Zhang, G. et al., "An Electro-Thermal Model for Metal-Oxide-Metal Antifused", "IEEE Transactions on Electron Devices", Aug. 1995, pp. 1548-1554, vol. 42, No. 8.

Brandes, G., "Electronic Device Including Circuitry Comprising Open-Failure-Susceptible Components, and Open Failure-Actuated Anti-Fuse Pathway", Co-Pending Unpublished U.S. Appl. No. 12/325,214, filed Nov. 30, 2008.

Benedetto, J., et al., "Amorphous Silicon Antifuse Programmable-Array-Logic Devices for High Relilability Space Applications ", "GOMAC '98, Arlington, VA", Mar. 1998, pp. 1-4.

Chiang, S., et al., "Antifuse Structure Comparison for Field Programmable Gate Arrays", "Electron Devices Meeting, 1992. IEDM '92. Technical Digest., International", Dec. 1992, pp. 611-614.

Gordon, K., et al., "Conducting Filament of the Programmed Metal Electrode Amorphous Silicon Antifuse", "Electron Devices Meeting, 1993. IEDM '93. Technical Digest., International", Dec. 1993, pp. 27-30.

Hamdy, E., et al., "Dielectric Based Antifuse for Logic and Memory ICs", "Electron Devices Meeting, 1988. IEDM '88. Technical Digest., International", Dec. 1988, pp. 786-789.

* cited by examiner

LED THERMAL MANAGEMENT SYSTEM AND METHOD

FIELD OF THE INVENTION

The present invention relates to LED devices and assemblies comprising same. Various aspects of the invention relate to an LED assembly having thermal management capability to protect the LED component(s) of the assembly from overheating. Other aspects of the invention relate to methods of thermal management of LED(s) to at least partially eliminate the occurrence of excessive temperature in LED(s) that are susceptible heat-mediated degradation of performance and/or operating life in use.

DESCRIPTION OF THE RELATED ART

In recent years, LED(s) have increasingly been employed as light sources in a variety of appliances, illumination products, instrumentation and display applications.

LED(s) have long operating lifetimes in relation to conventional incandescent and fluorescent light sources, and are susceptible to electronic control in multi-LED arrays that afford a wide variety of light outputs, color temperatures and light intensities.

Despite their advantages and increasing use, LED(s) at elevated temperatures are susceptible to degradation of performance and/or operating life. For example, an LED, having a given light output at ambient temperature (~25° C.), at elevated temperature (e.g., 80° C. and above) can experience significant degradation of the LED itself and associated phosphors, so that the LED assembly becomes less emissive and the light intensity is significantly attenuated. Temperature degradation in some instances can involve quantum well failure, and render the LED assembly deficient or even useless for its intended purpose.

Thermally-mediated LED degradation increases with increasing temperature. There is a strong correlation between temperature and the rate and extent of LED degradation above specific temperature levels. The temperature threshold at which LED performance and operating life become severely impacted by thermal effects varies according to the specific type of LED that is involved, but generally such threshold temperatures are on the order of 75°-95° C.

Below such threshold temperature, the LED performance and operating life are generally satisfactory, but above such threshold temperature, the LED is increasingly adversely affected by thermally-induced degradation and can rapidly experience failure. For such purpose, failure of an LED can be specified as a diminished lumen output that is less than 70% of the lumen output at 25° C. at the same current operating conditions.

LED(s) thus have a maximum operating temperature that when exceeded will result in relatively rapid and progressive degradation of LED performance and/or operating life. Excessively high LED operating temperatures may result from a variety of causes, including poor mounting of LED elements, unexpectedly high ambient temperatures, poorly designed drive circuitry, transient "spikes" or other systemic occurrences of high power input to the LED, as well as intentional "overdriving" of the LED.

Excessively high temperature operation of LED(s) is therefore pernicious, resulting in heat-mediated degradation of LED(s) that may involve adverse chemical changes, physical deterioration manifested by resin hardening, discoloration and embrittlement, precipitous decline in phosphor response to incident radiation from the LED, and quantum well failure.

It would be a significant advance in the art to provide LED assemblies and arrangements in which such heat-mediated degradation is ameliorated or eliminated.

SUMMARY OF THE INVENTION

The present invention relates to apparatus and method for thermal management of LED(s) that in use are susceptible to heat generation causing heat-mediated degradation of performance and/or operating life.

In one aspect, the invention relates to an LED assembly, comprising:

one or more LED(s); and a thermal controller arranged to respond to an LED operating condition, and responsively limit temperature in said one or more LED(s).

In a further aspect, the invention relates to a thermal control system adapted for operation with one or more LED(s), such thermal control system comprising a thermal controller arranged to respond to an LED operating condition, and responsively limit temperature in the one or more LED(s).

Another embodiment of the invention relates to an LED thermal management system for an LED, such system comprising:

a thermal protection assembly including a bypass circuit coupleable with a main circuit including the LED; and the bypass circuit including a bypass control element arranged to maintain the bypass circuit in a current non-flow condition when the LED is energized and at temperature below a threshold temperature, wherein the threshold temperature is in a range of from 75° to 95° C., and to at least partially re-route current in the main circuit through the bypass circuit around the LED and back to the main circuit, to an extent maintaining said LED below said threshold temperature when current flow through the LED in the main circuit would otherwise cause the LED to operate at or above said threshold temperature for an extended period of time.

In another aspect, the invention relates to a method of extending operating life of an LED that is susceptible to thermally mediated degradation at temperature above a threshold temperature, when power supplied to said LED would otherwise cause said LED to generate heat that would raise temperature of the LED above said threshold temperature, said method comprising at least one of the techniques of (I) at least partially attenuating said power supplied to said LED so as to reduce heat generation in said LED and maintain the LED in operation at or below the threshold temperature and (II) removing heat from said LED to maintain the LED in operation at or below the threshold temperature.

In a further embodiment, the invention relates to a thermally controlled LED assembly, comprising:

one or more LED(s); and a thermal management system arranged to respond to at least one LED operating condition that if unresponded to would produce heat damage to said one or more LED(s), said thermal management system in the absence of said at least one LED operating condition being inactive, and upon occurrence of said at least one LED operating condition being activated to reduce or prevent said heat damage.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
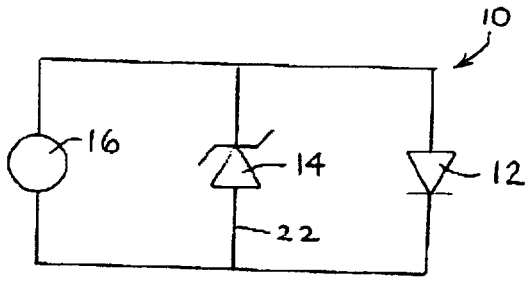
FIG. 1 is a thermal management circuit according to one embodiment of the invention, for thermal management of an LED that is susceptible to heat-mediated degradation of performance and/or operating life in use.

The present invention relates to thermal management of LED(s) that are susceptible to heat-mediated degradation of performance and/or operating life in use, and more specifically to apparatus and methods for thermal management of LED(s) to at least partially attenuate heat-mediated degradation of performance and/or operating life of such LED(s).

In one aspect, the invention contemplates an LED assembly, including at least one LED susceptible in use to heat generation causing heat-mediated degradation of performance and/or operating life, and a thermal controller operative to control heat generation in such one or more LED(s) so that the heat generation does not exceed a predetermined limit.

The predetermined limit of heat generation can comprise a predetermined LED temperature limit, a permissible thermal flux limit, a radiative emission of heat energy limit, or other limit measure of heat generation in the LED device. The predetermined limit may even be associated with a related parameter such as, for example, the resistance of the LED in steady state operation. As the temperature increases, the steady state resistance of the LED will increase.

The thermal management system utilized with the LED may be of any suitable type. In one embodiment, the thermal management system may include a controller that is operable to remove heat from the LED, and may for example include a heat sink structure that removes heat from the LED by conduction, radiation, convection or other heat transfer mechanism and thereby serves to reduce heat build-up in the LED and to maintain heat generation below the predetermined level, e.g., below a predetermined temperature limit. The heat sink structure in such embodiment may be formed of metal, ceramic, composite material or other substance having a high specific heat rendering it suitable as a heat sink medium.

The thermal controller in another embodiment comprises heat transfer surfaces arranged for convective cooling of the LED. Such heat transfer surfaces may for example include fins or other extended surface area structure, which is arranged with respect to a convective cooling device, e.g., fan, blower, eductor or other arrangement by which heat is transferred from the extended heat transfer surface to an ambient gas, e.g., air, in the environment containing the LED.

In still another embodiment, the LED may be arranged with a thermal controller comprising a thermoelectric cooler, which is adapted to thermoelectrically remove heat from the LED device.

A further embodiment of the invention involves use of a thermal controller including a bypass circuit that is actuated to divert current flow away from the LED upon occurrence of conditions that would otherwise cause heat generation in the LED to exceed the predetermined limit, so that the current flow to the LED does not reach a level that would allow heat generation to exceed the predetermined limit. The bypass circuit, as described hereinafter in greater detail, may contain a bypass control element, such as a Zener diode, varistor or antifuse device. The predetermined limit may be associated with a circuit parameter such as, for example, the resistance of the LED in steady state operation, thereby taking advantage of the fact that as the temperature of an LED increases, the steady state resistance of the LED will increase.

The LED assembly may be arranged so that the thermal control is adapted to limit power to the LED to a predetermined level upon occurrence of power conditions that would cause heat generation in the LED to exceed the predetermined limit, e.g., overload power conditions, transient surges, or the like.

The thermal management system that is utilized to thermally manage LED operation can be of varied type, arranged to respond to at least one LED operating condition that if unresponded to would produce heat damage to the one or more LED(s) that may be present. The thermal management system can be arranged to respond to one or more LED operating condition(s), with the thermal management system in the absence of such operating condition(s) being inactive, and upon occurrence of one or more of such operating condition(s) being activated to reduce or prevent heat damage to the LED(s).

One embodiment of the invention utilizes a thermal controller including a thermocouple that is adapted to monitor temperature of an LED and responsively generate a signal indicative of LED temperature. An actuator coupled in signal receiving relationship with the thermocouple then operates to receive the signal indicative of temperature, and responsively modulates operation of a cooling device, e.g., a thermoelectric cooler, so that heat generation in the LED does not exceed a predetermined limit.

The invention relates in one embodiment to a thermal control system adapted for operation with one or more LED(s) susceptible in use to heat generation causing heat-mediated degradation of performance and/or operating life, in which the thermal control system includes a thermal controller that is operative to prevent excessive heat generation in the LED so that heat generation does not exceed a predetermined limit. The thermal controller in such arrangement may comprise a bypass circuit that is actuatable to divert current flow from the LED upon occurrence of conditions that would otherwise cause heat generation in the LED to exceed the predetermined limit, so that the current flow to the LED does not allow heat generation to exceed such limit. The bypass circuit as mentioned may contain a bypass control element such as a Zener diode, varistor, or antifuse device, or a combination of one or more of such devices or combinations of any of such devices with other bypass control elements.

The invention relates in a further aspect to an LED thermal management system for an LED susceptible to thermally mediated degradation at temperature above a predetermined temperature. The system comprises a thermal protection assembly that under conditions effecting thermally mediated degradation is operative to at least partially attenuate power to the LED, to correspondingly reduce heat generation in the LED and maintain it at or below the predetermined temperature in operation. Such thermal protection assembly can include a bypass circuit of the type previously described, with the bypass circuit being coupled with the main circuit including the LED. The bypass circuit can include a bypass control element arranged to maintain the bypass circuit in a current non-flow condition when the LED is energized and at a temperature below the predetermined temperature, and to at least partially re-route current from the LED through the bypass circuit and back to the main circuit when the LED is energized and would otherwise generate heat that would raise its temperature above the predetermined temperature. The current re-routing thus is carried out to an extent that maintains the LED at or below the predetermined temperature when current flow through the LED in the main circuit would otherwise cause the LED to operate above the predetermined temperature.

In another embodiment, the invention relates to a thermally controlled LED assembly, comprising:

one or more LED(s); and a thermal management system arranged to respond to at least one LED operating condition that if unresponded to would produce heat damage to said one or more LED(s), such thermal management system in the absence of said at least one LED operating condition being inactive, and upon occurrence of the at least one LED operating condition being activated to reduce or prevent such heat damage.

In such thermally controlled LED assembly, the at least one operating condition can include any of current, voltage, power, resistance, and/or temperature conditions, e.g., a temperature in the one or more LED(s) above a threshold temperature in a range of from 75° to 95° C. For example, a set point temperature condition of 80° C. may be employed, as programmed in an actuator device that is arranged to actuate an active cooling apparatus when such set point temperature is reached. The active cooling apparatus is active when turned on by the actuator and is otherwise inactive. Active cooling apparatus useful in such practice of the invention can be of any suitable type, including fans, blowers, thermoelectric coolers, etc.

The thermal management system in such embodiment can be configured with a bypass circuit arranged to at least partially divert energy from the one or more LED(s) in response to the at least one LED operating condition.

The at least one LED operating condition that is used to trigger the thermal management action can include a set point operating condition, as previously described, or such operating condition can include a range or regime of operating conditions that if unaddressed by thermal management action, would result in excess heat buildup or other thermal degradation of performance and/or operating life of the affected LED(s).

By arrangements such as those described above, the invention provides an effective method of extending the operating life of an LED that is susceptible to thermally-mediated degradation at temperature above a predetermined temperature, by at least one of the techniques of (I) at least partially attenuating power to the LED to correspondingly reduce heat generation in said LED and maintain it at or below the predetermined temperature in operation, and (II) removing heat from the LED to maintain the LED at or below the predetermined temperature in operation.

It will be apparent that the invention contemplates a variety of arrangements and techniques for thermal management and control of LED devices. While the invention is described hereinafter with reference to illustrative circuitry including single LED elements, it is to be appreciated that the thermal management systems and methods of the present invention can be implemented in arrangements comprising a multiplicity of LED devices, such as in multi-LED displays, interior lighting arrangements, exterior lighting assemblies, personal lighting products, etc. It will also be recognized that the LED(s) utilized in the practice of the present invention may be arranged in assemblies with single or multiple phosphor elements for up-converting and/or down-converting of emitted light from the LED. It will also be appreciated that the techniques and approaches of the invention may be utilized to provide thermal management of more than one LED with a same thermal management arrangement or device.

For example, the bypass circuit, such as a bypass circuit containing a Zener diode bypass control element, can be used across multiple LED(s) arranged in series or parallel, so that one bypass circuit containing one bypass element serves a multiplicity of LED devices. As another example, a thermoelectric cooler can be associated with multiple LED devices. In other embodiments the LED assembly can be arranged to that each LED is protected with a single dedicated thermal management component or component arrangement for that single LED device.

As used herein, the singular forms “a”, “and”, and “the” include plural referents unless the context clearly dictates otherwise.

The invention in one embodiment utilizes a device in parallel with one or more LED(s), in order to responsively reduce the current through the LED(s) in an “overload” circumstance. The invention also contemplates utilization of active controls and feedback for reducing heat generated by a LED, or for carrying out heat extraction from the LED using a device such as a thermoelectric cooler. A thermoelectric cooler uses the Peltier effect to create a heat flux across the junction of two different types of materials. Such devices are well known to those of ordinary skill in the art.

Referring now to the drawings, FIG. 1 depicts an LED assembly including a thermal management circuit according to one embodiment of the invention, as arranged to thermally manage an LED that is susceptible to heat-mediated degradation of performance and/or operating life in use. In distinction to the use of Zener diodes for surge protection, the Zener voltage in this embodiment is selected to be within 50% of low-current, room temperature (e.g., 25° C.) operating voltage of the LED. In various embodiments, the selected Zener voltage is within 25%, 10% or even 5% of such operating voltage, for effecting thermal management of LED operation.

As shown, the assembly 10 includes an LED 12 coupled in circuit relationship with a power supply 16. The LED assembly 10 is arranged with a Zener diode 14 in branch line 22, with the voltage of the Zener diode selected so that the Zener diode acts as a current shunt under circumstances in which power to the LED 12 would otherwise cause the LED to overheat and degrade in illumination output and/or performance life. It is understood that for protective purposes the voltage should be chosen to prevent excessive temperature, but it cannot be so low that the LED is prevented from turning on when power is supplied to the circuit.

Figure 2:
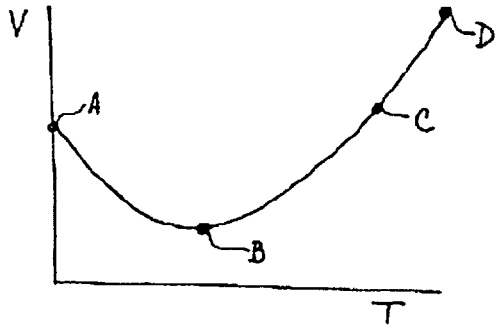
FIG. 2 is a graph of voltage as a function of temperature, for an LED with no thermal management elements associated therewith.

FIG. 2 is a graph of voltage as a function of temperature, for an LED with no associated thermal management.

In the FIG. 2 graph, representing voltage performance of an LED, point A of the graph represents the actuation of the power supply to energize the light emitting diode for light emission. As the light emitting diode warms (point B), the voltage drops, and then rises with increasing temperature (point C). If the diode then is driven by excessively large current or experiences a power surge, the temperature and voltage will rise (point D) and the LED will be correspondingly adversely impacted by the excessive heat generation.

Figure 3:
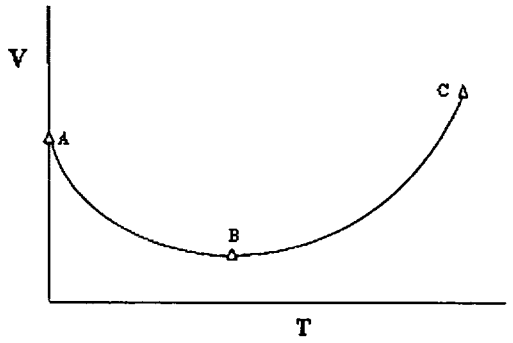
FIG. 3 is a graph of voltage as a function of temperature, for a circuit of the type shown in FIG. 1, showing temperature as being controlled within a predetermined operating range below an upper temperature limit.

FIG. 3 is a graph of voltage as a function of temperature, for an LED circuit of the type shown in FIG. 1, showing temperature as being controlled within a predetermined operating range and below a predetermined temperature limit.

The voltage-temperature curve in FIG. 3 shows the performance of the circuit of FIG. 1 with a bypass line 22 containing a Zener diode in parallel with the LED 12.

The turn on voltage again is indicated at point A, and the curve experiences a similar development as in FIG. 2, with the voltage dropping (point B) as the diode warms in operation, and as the voltage and temperature further rise, the Zener diode 14 is actuated and limits voltage and temperature (point C). Thus, the Zener diode acts as a current shunt and serves to thermally manage the LED 12 so that it does not experience increase in temperature beyond point C. The point C temperature is a predetermined temperature at or below which heat-mediated degradation is minimized or otherwise contained within an acceptable limit. The voltage point C, however, must be above the voltage A to enable turn on of the LED.

Figure 4:
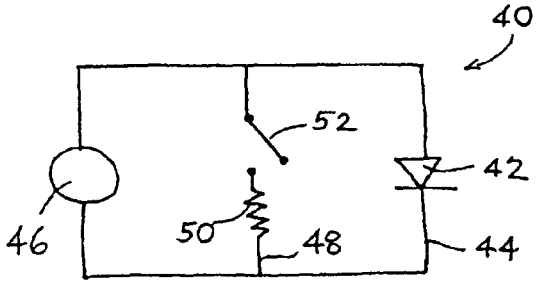
FIG. 4 is an LED assembly including a thermal management circuit, according to another embodiment of the invention.

FIG. 4 is an LED assembly including a thermal management circuit, according to another embodiment of the invention.

The thermal management circuit in FIG. 4 represents another arrangement in which a thermal control device is arranged in parallel with the LED. In this circuit 40, LED 42 is in a main circuit 44 including power supply 46. The LED 42 is arranged in parallel with bypass line 48 containing a resistor 50 and switch 52. The switch can be of any suitable type and may for example comprise a metal (bi-layer) switch that is arranged to open when temperatures are below a certain value, and when temperature rises above such value, the switch will close to effect bypassing of current through the bypass line 48 so that current flow through LED 42 is reduced. The switch alternatively can be constituted by a semiconducting layer that is heat-responsive to permit or prevent current flow, depending on the specific temperature, so that temperature rise in the LED triggers bypass current flow through the bypass circuit, with the switch being otherwise open to allow full current flow through the LED device. The switch may for example be constructed using a wide bandgap semiconductor with a deep level dopant, with the switch and the LED being attached to a mounting plate. At room temperature few, if any carriers are activated and the semiconductor switch is open. When the mounting plate heats up, the carriers become thermally activated and current may be shunted along this alternative path until the mounting plate temperature drops. If the semiconductor switch is chosen with appropriate values, it may act as both a switch and the resistor 48.

Figure 5:
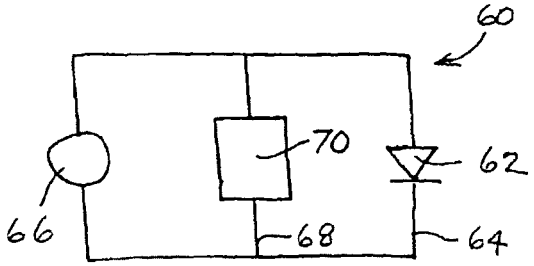
FIG. 5 is an LED assembly including a thermal management arrangement according to yet another embodiment of the invention.
Figure 7:
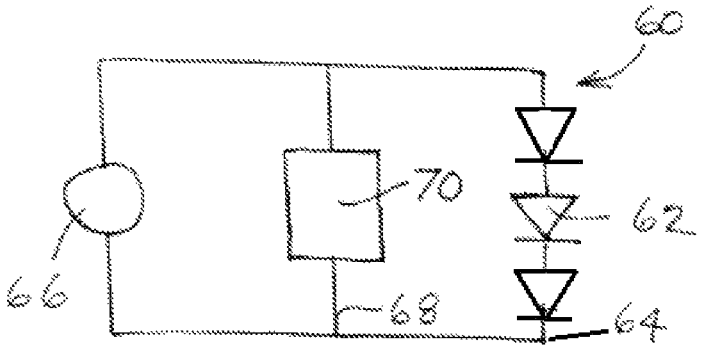
FIG. 7 is an LED assembly including a thermal management arrangement according to yet another embodiment of the invention.

Another LED assembly arrangement is shown in FIG. 5, which includes a thermal management system according to yet another embodiment of the invention. FIG. 7 shows the same thermal management system as FIG. 5 with multiple LEDs.

In LED assembly 60, the main circuit 64 contains LED 62 coupled with power supply 66. A thermal controller 70 is disposed in bypass line 68. The thermal controller can be of any suitable type and can for example include materials, components, and/or sub-assemblies that in response to conditions that would otherwise result in undesired heat generation in the LED, e.g., LED temperature above a predetermined level, causes current to the LED to be reduced, or otherwise diverted through the bypass line 68 and the thermal controller. The thermal controller can be constructed and arranged to pass current, wholly or partially, through the bypass line 68, so that the LED does not overheat and is maintained at a temperature below the threshold at which degradation becomes unacceptably high in rate and/or extent.

The thermal controller 70 may employ any suitable construction, and may for example include a temperature controller embedded in a modular board and arranged to control current flow and/or to provide heat sink capability, or to otherwise thermally control the LED so that it does not heat beyond the desired predetermined level.

In other embodiments, some or all of the thermal controller structure may be embedded in a lamp or module as a part of the LED assembly. The thermal controller in still other embodiments may be positioned across multiple LED (s) configured in series and/or in parallel. The thermal controller can be variously arranged to control current to the LED so that the current is modulated under variable power conditions, to maintain the LED within a desired envelope of operating current conditions.

Figure 6:
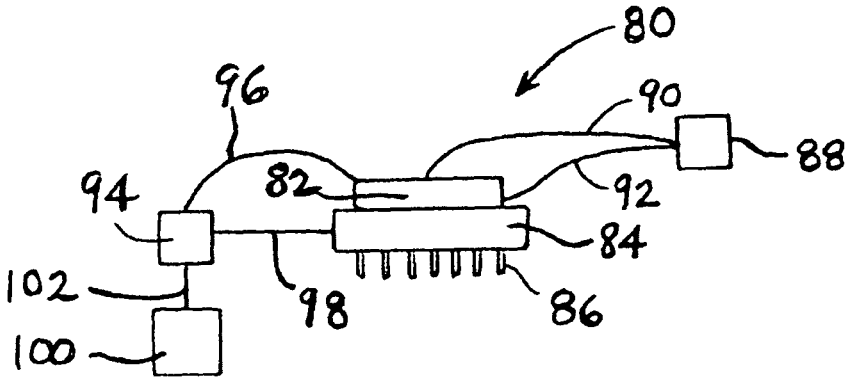
FIG. 6 is a schematic representation of an LED device operatively arranged with a thermoelectric cooler and control elements, for maintaining temperature of the LED below a predetermined limit in use.

FIG. 6 is a schematic representation of an LED device operatively arranged with a thermoelectric cooler and control elements, for maintaining operating temperature of the LED below a predetermined limit.

The LED assembly 80 shown in FIG. 6 includes LED 82 coupled to a power supply 88 by leads 90 and 92. The LED is reposed on a thermoelectric cooler 84 having cooling fins 86 depending downwardly from the bottom surface thereof, as illustrated.

The LED assembly further includes a thermocouple lead 96 arranged to sense temperature of the LED and responsively generate a signal that is transmitted to the feedback actuator 94. The feedback actuator 94 is coupled by power line 102 with a power supply 100, so that the actuator is arranged to modulate the power transmitted in power transmission line 98 to the thermoelectric cooler 84, in response to the temperature signal transmitted by the thermocouple lead 96 to the actuator.

In this manner, the power sent to the thermoelectric cooler is modulated to vary the heat removal duty of such cooler, in response to temperature sensed by the thermocouple that is attached in signal transmission relationship to the actuator.

The LED 82 thereby is maintained in a temperature operating range that is consistent with good illumination performance and long operating life, so that any conditions that would otherwise result in excess heat generation in the LED are avoided.

It will be appreciated that power monitoring and control arrangements may be employed, utilizing variable resistance control elements to maintain power at a predetermined level, so that the LED is energized without overheating, in circumstances in which the supplied current may be highly variable in character. Such power monitoring and control arrangements are useful to maintain the LED in a desired "cool" operating regime under variable current conditions, to prevent uncontrolled variations in power level that would occur if changes of the resistance of the control elements in the thermal control assembly were not employed to compensate for the current variations.

Thus, the invention contemplates a thermally-controlled LED assembly, comprising:

one or more LED(s); and a thermal controller arranged to respond to an LED operating condition, and responsively limit temperature in such one or more LED(s).

The LED operating condition(s) for such purpose can be of any suitable character and can for example be selected from among: current flow to the one or more LED(s), voltage applied to the one or more LED(s), power supplied to the one or more LED(s), temperature in the one or more LED(s), and temperature of an ambient environment of the LED assembly. It is to be appreciated that these parameters may be adjusted in value, or they may be modulated temporally, with the duty cycle being adjusted. The LED(s) may for example be switched on and off as necessary to keep them from getting excessively hot.

The LEDs in such assembly may utilize the current flow to the one or more LED(s) as the LED operating condition, and the thermal controller may be arranged to limit current flow to the one or more LED(s) to correspondingly limit temperature in such one or more LED(s).

In another embodiment, the LED operating condition is applied voltage to the one or more LEDs, and the thermal controller is arranged to limit voltage applied to the one or more LED(s) to correspondingly limit temperature in the one or more LED(s).

In still another embodiment, the LED operating condition is power supplied to the one or more LED(s), and the thermal controller is arranged to limit power supplied to the one or more LED(s) to correspondingly limit temperature in the one or more LED(s).

The LED operating condition can alternatively include temperature in the one or more LED(s), e.g., a temperature above a threshold temperature in a range of from 75° to 95° C.

The thermally-controlled LED assembly can be arranged to include, as the LED operating condition, temperature in the one or more LED(s), with the thermal controller being arranged to responsively actuate a cooling element for cooling of the one or more LED(s) to correspondingly limit temperature therein. The thermal controller can alternatively comprise a bypass circuit that is arranged to at least partially divert energy from the one or more LED(s) in response to the LED operating condition, in which the bypass circuit may contain a bypass control element that is selected from among Zener diodes, varistors, and antifuse devices. The thermally controlled LED assembly may be active or passive in nature. The active system may for example be actuated by set point operation involving a particular condition correlative with thermal degradation of an LED, so that an actuating signal is propagated by the thermal management system when the condition appears. Such active thermal management system may be arranged with continuous or intermittent monitoring of the condition(s) of interest, so that thermal management operation is responsively initiated when the monitored condition(s) indicate actual adverse heating of the LED, or potential adverse heating of the LED if uncorrected.

The thermal controller may be variously constructed, as comprising, for example, a heat sink structure, heat transfer surface(s) arranged for convective cooling of the one or more LED(s), or a thermoelectric cooler. In another arrangement of a thermally controlled LED assembly, the thermal controller further comprises a thermocouple adapted to monitor temperature of the one or more LED(s) and responsively generate a signal indicative of such temperature, and an actuator coupled in signal receiving relationship with the thermocouple to receive the signal indicative of the temperature, and to responsively modulate operation of the thermoelectric cooler to limit temperature in the one or more LED(s).

The invention in another aspect encompasses a thermal control system adapted for operation with one or more LED(s), with such thermal control system comprising a thermal controller arranged to respond to an LED operating condition, and responsively limit temperature in the one or more LED(s). The thermal controller may for example include a bypass circuit that is arranged to at least partially divert energy from the one or more LED(s) in response to the LED operating condition. The bypass circuit may for example be configured with a bypass control element selected from among Zener diodes, varistors, and antifuse devices. More than one type of bypass control element may be employed in a given LED assembly, and the bypass circuit may be across one LED element, or across more than one LED element in such assembly.

The invention in a further aspect relates to a LED thermal management system for an LED. The system can for example include:

a thermal protection assembly including a bypass circuit coupleable with a main circuit including the LED; and the bypass circuit including a bypass control element that is arranged to maintain the bypass circuit in a current non-flow condition when the LED is energized and at temperature below a threshold temperature, wherein the threshold temperature can for example be in a range of from 75° to 95° C., and to at least partially re-route current in the main circuit through the bypass circuit around the LED and back to the main circuit, to an extent maintaining said LED below said threshold temperature when current flow through the LED in the main circuit would otherwise cause the LED to operate at or above the threshold temperature for an extended period of time. The bypass circuit may be enabled when the LED overheats, to reduce heating in the LED, so that there is a delay in the active thermal management, or the bypass circuit in other implementations may be arranged so that active thermal management is initiated upon approach to such overheating.

The bypass control element in the LED thermal management system described above can be of any suitable type, e.g., a component selected from the group consisting of Zener diodes, varistors, and thermoelectric coolers.

The invention correspondingly provides a method of extending operating life of an LED that is susceptible to thermally mediated degradation at temperature above a threshold temperature, when power supplied to the LED would otherwise cause the LED to generate heat that would raise temperature of the LED above the threshold temperature, such method comprising at least one of the techniques of (I) at least partially attenuating the power supplied to said LED so as to reduce heat generation in the LED and maintain the LED in operation at or below the threshold temperature and (II) removing heat from the LED to maintain the LED in operation at or below the threshold temperature. Techniques (I), or (II), or both (I) and (II) can be employed.

Such method can include the step of at least partially re-routing current around the LED through a bypass circuit and back to a main circuit containing the LED, to an extent maintaining the LED at or below the threshold temperature. The bypass circuit may contain a bypass control element, e.g., Zener diodes, varistors, and/or antifuse devices. The method may also comprise use of a heat sink structure arranged to remove heat from the LED, the use of a thermal controller including heat transfer surface(s) arranged for convective cooling to remove heat from the LED, or the use of a thermoelectric cooler arranged to remove heat from the LED.

The method in a further variant may include monitoring temperature of the LED, responsively generating a signal indicative of such temperature, transmitting the signal to an actuator that is arranged to responsively modulate a cooler, e.g., a thermoelectric cooler, arranged for cooling the LED, to maintain the LED at or below the threshold temperature in operation.

The invention, as variously described herein in respect of features, aspects and embodiments thereof, may in particular implementations be constituted as comprising, consisting, or consisting essentially of, some or all of such features, aspects and embodiments, as well as elements and components thereof, in various further implementations of the invention.

Thus, while the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Correspondingly, the invention as hereinafter claimed is intended to be broadly construed and interpreted, as including all such variations, modifications and alternative embodiments, within its spirit and scope.

What is claimed is:

1. A thermally-controlled light emitting diode (LED) assembly, comprising:

multiple LEDs attached to a mounting plate, wherein the multiple LEDs are arranged in one of (i) a series arrangement, (ii) a parallel arrangement, and (iii) a series and parallel arrangement; and a bypass line, wherein the bypass line includes a switch that is responsive to temperature and a resistor, wherein the bypass line is coupled in parallel with the multiple LEDs and arranged to respond to a temperature of the mounting plate to at least partially divert current around the multiple LEDs and responsively limit operating temperature of the multiple LEDs when the temperature of the mounting plate exceeds a predetermined value while maintaining at least a partial current flow through the multiple LEDs to energize the multiple LEDs, and further comprising a thermal controller arranged to responsively actuate a cooling element for cooling of the multiple LEDs to correspondingly reduce said operating temperature of the multiple LEDs, wherein the cooling element comprises heat transfer surface(s) arranged for convective cooling of the multiple LEDs and wherein the cooling element comprises a thermoelectric cooler.

2. The thermally-controlled LED assembly of claim 1, wherein the switch is arranged to at least partially divert said current around the multiple LEDs when the temperature of the mounting plate exceeds the predetermined value in a range of from 75° to 95° C.

3. The thermally-controlled LED assembly of claim 1, wherein the thermal controller further comprises (i) a thermocouple adapted to monitor said operating temperature of the multiple LEDs and to responsively generate a signal indicative of said operating temperature of the multiple LEDs, and (ii) an actuator coupled in a signal receiving relationship with the thermocouple to receive the signal indicative of said operating temperature of the multiple LEDs and to responsively modulate operation of the thermoelectric cooler.

4. The thermally-controlled LED assembly of claim 3, wherein the bypass line is coupled in parallel with a main circuit including the multiple LEDs.

5. The thermally-controlled LED assembly of claim 1, wherein the switch is attached to the mounting plate.

6. The thermally-controlled LED assembly of claim 1, wherein the switch comprises a semiconductor switch including a wide bandgap semiconductor in which carriers are activated by heat, wherein:

when the mounting plate temperature below a predetermined value, the semiconductor switch is open; and when the mounting plate temperature reaches the predetermined value, the carriers in the semiconductor switch enable current to be shunted through the semiconductor switch to at least partially divert current around the multiple LEDs.

7. The thermally-controlled LED assembly of claim 6, wherein one of:

the semiconductor switch is configured to include the switch and the resistor; and the switch and the resistor are separate components coupled in series.

8. A thermal control system adapted for operation with multiple light emitting diodes (LEDs) attached to a mounting plate and arranged in one of (i) a series arrangement, (ii) a parallel arrangement, and (iii) a series and parallel arrangement, said thermal control system comprising a bypass circuit coupled in parallel with said multiple LEDs and arranged to respond to a temperature of the mounting plate to partially divert current from said multiple LEDs to responsively limit said operating temperature of said multiple LEDs, and further comprising a thermal controller arranged to responsively actuate a cooling element for cooling of the multiple LEDs to correspondingly reduce said operating temperature of the multiple LEDs, wherein the cooling element comprises heat transfer surface(s) arranged for convective cooling of the multiple LEDs and wherein the cooling element comprises a thermoelectric cooler.

9. The thermal control system of claim 8, wherein said thermal control system is arranged to respond to partially divert the current around said multiple LEDs to responsively limit said operating temperature to an operating range of from 75° to 95° C.

10. The thermal control system of claim 8, wherein the bypass circuit is attached to the mounting plate.

11. The thermal control system of claim 8, wherein the bypass circuit comprises a semiconductor switch attached to the mounting plate, wherein the semiconductor switch includes a wide bandgap semiconductor in which carriers are activated by heat, wherein:

when the mounting plate temperature is below a predetermined value, the semiconductor switch is open; and when the mounting plate temperature reaches the predetermined value, the carriers in the semiconductor switch enable current to be shunted through the semiconductor switch to partially divert current from the multiple LEDs.

12. The thermal control system of claim 11, wherein the bypass circuit further comprises a resistor, wherein the resistor is one of part of the semiconductor switch and serially coupled with the semiconductor switch.

13. The thermal control system of claim 8, wherein the bypass circuit comprises a resistor and a bi-layer metal switch attached to the mounting plate, wherein the bi-layer metal switch is adapted to open when a temperature of the mounting plate is below a predetermined value and to close when the temperature at least reaches the predetermined value such that a flow of bypass current through the bi-layer metal switch and the resistor reduces a flow of current through the multiple LEDs to reduce the operating temperature of the multiple LEDs.

14. A light emitting diode (LED) thermal management system for multiple LEDs, said system comprising:

a thermal protection assembly including an active bypass circuit coupled in parallel with the multiple LEDs, wherein the multiple LEDs are arranged in one of (i) a series arrangement, (ii) a parallel arrangement, and (iii) a series and parallel arrangement, and wherein the multiple LEDs and the active bypass circuit are attached to a mounting plate; and the active bypass circuit including a bypass control element arranged (i) to maintain the active bypass circuit in a current non-flow condition when the multiple LEDs are energized and the mounting plate is at a temperature below a predetermined value in a range of from 75° to 95° C., and (ii) to partially re-route current through the active bypass circuit around the multiple LEDs to an extent maintaining said temperature of the mounting plate below the predetermined value when current flow through the multiple LEDs would otherwise cause the multiple LEDs to operate at or above the predetermined value, while maintaining at least a partial current flow through the multiple LEDs to energize the multiple LEDs, further comprising a thermoelectric cooler configured to be energized when a monitored temperature of the multiple LEDs exceeds a threshold temperature.

15. The LED thermal management system of claim 14, wherein the bypass control element comprises a varistor.

16. The LED thermal management system of claim 14, wherein the active bypass circuit comprises a semiconductor switch including a wide bandgap semiconductor in which carriers are activated by heat, wherein:

when the mounting plate temperature below a predetermined value, the semiconductor switch is open; and when the mounting plate temperature reaches the predetermined value, the carriers in the semiconductor switch enable current to be shunted through the semiconductor switch to partially divert current from the multiple LEDs.

17. A method of extending operating life of multiple light emitting diodes (LEDs) that are arranged in one of (i) a series arrangement, (ii) a parallel arrangement, and (iii) a series and parallel arrangement and that are susceptible to thermally mediated degradation at temperature above a threshold temperature, when power supplied to said multiple LEDs would otherwise cause said multiple LEDs to generate heat that would raise an operating temperature of said multiple LEDs above said threshold temperature, said method comprising determining a temperature of a mounting plate to which said multiple LEDs are attached and, when the temperature of the mounting plate reaches a predetermined value, at least partially diverting said power supplied to said multiple LEDs through an active bypass circuit coupled in parallel with said multiple LEDs so as to reduce heat generation of said multiple LEDs while said multiple LEDs remain at least partially energized to maintain said operating temperature at or below said threshold temperature, further comprising monitoring the operating temperature of said multiple LEDs, responsively generating a signal indicative of said operating temperature, and transmitting the signal to an actuator that is arranged to responsively modulate a cooler arranged for removing heat from said multiple LEDs, to maintain said multiple LEDs at or below said threshold temperature while said multiple LEDs remain at least partially energized, wherein the cooler comprises a thermoelectric cooler.

18. The method of claim 17, wherein said active bypass circuit contains a bypass control element selected from the group consisting of varistors and antifuse devices.

19. The method of claim 17, wherein said threshold temperature is in a range from 75° to 95° C.

20. A thermally controlled light emitting diode (LED) assembly, comprising:

multiple LEDs attached to a mounting plate, wherein the multiple LEDs are arranged in one of (i) a series arrangement, (ii) a parallel arrangement, and (iii) a series and parallel arrangement; and a partial bypass circuit coupled in parallel with the multiple LEDs and arranged to respond to a temperature of the mounting plate indicating an excessive operating temperature of at least one of the multiple LEDs that if unresponded to would cause thermal damage in the at least one of the multiple LEDs, said partial bypass circuit in the absence of said excessive temperature being inactive, and upon occurrence of said excessive operating temperature being activated to reduce heat generation of the at least one of the multiple LEDs by partially re-routing current around the at least one of the multiple LEDs while maintaining at least a partial current flow through the at least one of the multiple LEDs to energize the at least one of the multiple LEDs, wherein the partial bypass circuit includes a semiconductor switch comprised of a wide bandgap semiconductor attached to the mounting plate in which carriers in the wide bandgap semiconductor are activated by heat, wherein:

when the mounting plate temperature is below the predetermined value, the semiconductor switch is open; and when the mounting plate temperature reaches the predetermined value, carriers in the semiconductor switch enable current to be shunted through the semiconductor switch, and further comprising an active cooling apparatus arranged to cool said multiple LEDs in response to said excessive operating temperature, wherein the active cooling apparatus is a thermoelectric cooler.

21. The thermally controlled LED assembly according to claim 20, wherein said excessive operating temperature of the at least one of the multiple LEDs exceeds a threshold temperature in a range of from 75° to 95° C.

22. A thermally-controlled light emitting diode (LED) assembly, comprising:

multiple LEDs attached to a mounting plate, wherein the multiple LEDs are arranged in one of (i) a series arrangement, (ii) a parallel arrangement, and (iii) a series and parallel arrangement; and a bypass circuit coupled in parallel with the multiple LEDs, wherein the bypass circuit includes a resistor and a bi-layer metal switch attached to the mounting plate, wherein the bi-layer metal switch is adapted to open when a temperature of the mounting plate is below a predetermined value and to close when the temperature at least reaches the predetermined value such that a flow of bypass current through the bi-layer metal switch and the resistor reduces a flow of current through the multiple LEDs to reduce an operating temperature of the multiple LEDs, and further comprising a thermal controller arranged to responsively actuate a cooling element for cooling of the multiple LEDs to correspondingly reduce said operating temperature of the multiple LEDs, wherein the cooling element comprises a thermoelectric cooler.

* * * * *